US009995094B2

(12) United States Patent
Fulks

(10) Patent No.: US 9,995,094 B2
(45) Date of Patent: Jun. 12, 2018

(54) POWERED MILLING CLAMP FOR DRILL PIPE

(71) Applicant: CONSOLIDATED RIG WORKS L.P., Fort Worth, TX (US)

(72) Inventor: Caleb E. M. Fulks, McKinney, TX (US)

(73) Assignee: CONSOLIDATED RIG WORKS L.P., Fort Worth, TX (US)

( * ) Notice: Subject to any disclaimer, the term of this patent is extended or adjusted under 35 U.S.C. 154(b) by 396 days.

(21) Appl. No.: 14/643,700

(22) Filed: Mar. 10, 2015

(65) Prior Publication Data

US 2015/0252633 A1 Sep. 10, 2015

Related U.S. Application Data

(60) Provisional application No. 61/950,505, filed on Mar. 10, 2014.

(51) Int. Cl.
*E21B 19/12* (2006.01)
*E21B 3/00* (2006.01)

(52) U.S. Cl.
CPC ..... *E21B 19/12* (2013.01); *E21B 3/00* (2013.01)

(58) Field of Classification Search
CPC ..... E21B 19/16; E21B 19/163; E21B 19/164; E21B 19/12; E21B 3/00; B25B 1/241
USPC ..... 81/18, 19, 21, 57.18
See application file for complete search history.

(56) References Cited

U.S. PATENT DOCUMENTS

| | | | | |
|---|---|---|---|---|
| 2,550,045 | A * | 4/1951 | De Hetre | E21B 19/164 279/110 |
| 2,567,009 | A | 9/1951 | Calhoun et al. | |
| 3,285,485 | A | 11/1966 | Slator | |
| 3,317,103 | A | 5/1967 | Cullen et al. | |
| 4,336,901 | A | 6/1982 | Gray | |
| 4,585,061 | A | 4/1986 | Lyons et al. | |
| 4,655,291 | A | 4/1987 | Cox | |
| 4,735,270 | A | 4/1988 | Fenyvesi | |

(Continued)

FOREIGN PATENT DOCUMENTS

| | | |
|---|---|---|
| AU | 2006316335 | 12/2011 |
| AU | 2007306067 | 12/2012 |

(Continued)

*Primary Examiner* — Monica Carter
*Assistant Examiner* — Lauren Beronja
(74) *Attorney, Agent, or Firm* — Munck Wilson Mandala, LLP

(57) ABSTRACT

A powered clamp for transmitting torque to a drill pipe comprises an outer housing disposed around an axial central passage and connected to a plurality of carrier guides defining a plurality of radial slots. An inner housing defines a coaxial central passage, is rotatably connected to the outer housing, and defines a plurality of actuator slots having a spiral configuration relative to the centerline axis. A carrier is slidably disposed in each slot between the carrier guides and has a carrier pin extending into a respective one of the actuator slots. At least one powered linear actuator is connected between the outer and inner housing to selectively rotate the housings relative to one another. This rotation causes the carriers to move radially inward and outward as the carrier pins travel along the actuator slots, selectively gripping and releasing the drill pipe.

15 Claims, 7 Drawing Sheets

(56) References Cited

U.S. PATENT DOCUMENTS

| | | | | |
|---|---|---|---|---|
| 4,899,823 | A | 2/1990 | Cobb et al. | |
| 4,940,095 | A | 7/1990 | Newman | |
| 5,133,405 | A | 7/1992 | Elliston | |
| 5,188,174 | A | 2/1993 | Anderson | |
| 5,309,990 | A | 5/1994 | Lance | |
| 5,553,668 | A | 9/1996 | Council et al. | |
| 5,566,764 | A | 10/1996 | Elliston | |
| 5,765,643 | A | 6/1998 | Shaaban et al. | |
| 5,775,417 | A | 7/1998 | Council et al. | |
| 5,803,168 | A | 9/1998 | Lormand et al. | |
| 5,845,708 | A | 12/1998 | Burge et al. | |
| 5,890,534 | A | 4/1999 | Burge et al. | |
| 5,918,671 | A | 7/1999 | Bridges et al. | |
| 5,937,943 | A | 8/1999 | Butler | |
| 5,975,203 | A | 11/1999 | Payne et al. | |
| 6,082,224 | A * | 7/2000 | McDaniels | B25B 1/241 81/57.15 |
| 6,135,202 | A | 10/2000 | Koshak | |
| 6,173,769 | B1 | 1/2001 | Goode | |
| 6,209,634 | B1 | 4/2001 | Avakov et al. | |
| 6,216,780 | B1 | 4/2001 | Goode et al. | |
| 6,330,911 | B1 * | 12/2001 | Allen | E21B 19/164 166/379 |
| 6,347,664 | B1 | 2/2002 | Perio et al. | |
| 6,412,560 | B1 | 7/2002 | Bernat | |
| 6,516,891 | B1 | 2/2003 | Dallas | |
| 6,609,566 | B2 | 8/2003 | Perio | |
| 6,892,810 | B2 | 5/2005 | Austbo et al. | |
| 7,051,814 | B2 | 5/2006 | Goode et al. | |
| 7,124,815 | B2 | 10/2006 | Rosine et al. | |
| 7,708,058 | B1 | 5/2010 | Gipson | |
| 7,795,572 | B2 * | 9/2010 | Jung | G06F 3/0304 250/208.1 |
| 7,857,042 | B2 | 12/2010 | Koopmans et al. | |
| 8,453,541 | B2 * | 6/2013 | Dagenais | E21B 19/164 81/57.15 |
| 2003/0209346 | A1 | 11/2003 | Austbo et al. | |
| 2004/0020661 | A1 | 2/2004 | Simpson et al. | |
| 2004/0211555 | A1 | 10/2004 | Austbo et al. | |
| 2005/0205267 | A1 | 9/2005 | Dallas | |
| 2008/0000330 | A1 * | 1/2008 | Basler | E21B 19/164 81/57.15 |
| 2008/0296013 | A1 | 12/2008 | Pleskie | |
| 2010/0108329 | A1 | 5/2010 | Kotsonis et al. | |
| 2010/0199812 | A1 * | 8/2010 | Richardson | E21B 19/164 81/57.11 |
| 2012/0085553 | A1 | 4/2012 | Shampine | |
| 2012/0247787 | A1 | 10/2012 | Lancaster | |
| 2013/0056224 | A1 | 3/2013 | Angelle et al. | |

FOREIGN PATENT DOCUMENTS

| | | |
|---|---|---|
| CA | 2797911 | 2/2002 |
| CA | 2335678 | 10/2004 |
| CA | 2461977 | 9/2005 |
| CA | 2506405 | 1/2008 |
| CA | 2506396 | 7/2008 |
| CA | 2530076 | 8/2010 |
| CA | 2414882 | 12/2010 |
| CA | 2699906 | 2/2011 |
| CA | 2791852 | 9/2011 |
| CA | 2812220 | 3/2012 |
| CN | 201297134 | 8/2009 |
| CN | 201297141 | 8/2009 |
| CN | 102155172 | 8/2011 |
| CN | 202578585 | 12/2012 |
| EP | 1090206 | 4/2001 |
| FR | 1461032 | 2/1967 |
| FR | 2062936 | 7/1971 |
| GB | 1402076 | 8/1975 |
| GB | 2326178 | 12/1998 |
| GB | 2358654 | 4/2004 |
| WO | WO9927223 | 6/1999 |
| WO | WO0017481 | 3/2000 |
| WO | WO0157355 | 11/2001 |
| WO | WO2011146623 | 11/2011 |
| WO | WO2011126377 | 6/2012 |
| WO | WO2013033568 | 3/2013 |

* cited by examiner

POWERED MILLING CLAMP FOR DRILL PIPE

CROSS-REFERENCE TO RELATED APPLICATIONS

This application claims benefit of U.S. Provisional Application No. 61/950,505, filed Mar. 10, 2014, entitled POWERED MILLING CLAMP FOR DRILL PIPE, the specification of which is incorporated by reference herein in its entirety.

TECHNICAL FIELD

The following disclosure relates to mechanical equipment used in oil field operations, and in particular to high-capacity clamps for transmitting rotational torque to drill pipe or casing. In one embodiment, a powered clamp transmits rotational torque from the rotary of a snubbing jack or rig assist unit to drill pipe or casing during continuous rotation operations such as milling or drilling. The power for the clamp may be supplied by hydraulic, pneumatic or electric actuators.

BACKGROUND

During the operation of a snubbing jack or rig assist unit, it is sometimes necessary to use the unit's powered rotary to drill or mill out material down-hole. The slip bowls that are used to hold the drill pipe (i.e., in the vertical direction) are not rated to handle torque. Because of this, a milling clamp is typically employed to transmit the torque from the rotary to the drill pipe/casing.

The most prevalent type of milling clamp currently used in the oil field industry today is a manual milling clamp that consists of a collar with set screws or T-bolts that are tightened against the pipe in order to transmit torque. Using such manual milling clamps may be labor-intensive, time consuming and/or inconvenient. A need therefore exists, for a milling clamp that is more convenient and less labor-intensive and time consuming to use.

SUMMARY

In one aspect thereof, a powered milling clamp comprises an outer housing, an inner housing, industry standard back-up power tong inserts for gripping pipe, tangentially oriented and radially spaced linear actuators (hydraulic, pneumatic, or electric), and tapered inner housing support rollers. The outer housing is fixed to, and rotates with, the rotary. The inner housing rides on radially spaced tapered rollers. The linear actuators couple the outer and inner housings and rotate the inner housing with respect to the outer housing. The carriers are held tangentially relative to the outer housing by locating blocks or tracks. There is a pin on each carrier that rides in an associated slot in the inner housing. As the inner housing is rotated, the slots drive the carriers and pipe inserts radially into contact with the drill pipe/casing. Additional force from the linear actuators creates a substantial clamp load on the drill pipe. This clamp load transmits the torque from the rotary to the drill pipe/casing. The powered milling clamp can be sized according to the customer's specification to accommodate multiple drill pipe/casing diameters and torque ratings. The powered milling clamp is more efficient, safer and more reliable than the existing manual milling clamps.

In another aspect, a powered clamp for transmitting rotational torque from a rotary drive to a drill pipe comprises an outer housing adapted for releasable attachment to the rotary drive to receive torque from the rotary drive, the outer housing having an upper plate and a lower plate connected to a plurality of carrier guides disposed therebetween. The upper plate and lower plate define a central passage along a clamp centerline axis, and the plurality of carrier guides define a plurality of slots between one another, the slots being radially oriented with respect to the clamp centerline axis. The clamp further comprises an inner housing having a top plate and a bottom plate connected to a plurality of spacers disposed therebetween and defining a central passage along the clamp centerline axis. The inner housing is disposed between the upper and lower plates of the outer housing and is rotatably connected to the outer housing to allow rotation of the inner housing about the clamp centerline axis relative to the outer housing. At least one of the top and bottom plates defines a plurality of actuator slots therein, the actuator slots having a generally spiral configuration relative to the clamp centerline axis. A plurality of carriers are slidably disposed between the top and bottom plates of the inner housing and in the slots between the carrier guides, each carrier having a carrier pin extending into one of the actuator slots of the inner housing. The clamp further comprises at least one powered linear actuator oriented substantially tangential to the clamp centerline axis and connected at a first end to the outer housing and at a second end to the inner housing. Selective extension and retraction of the linear actuator causes the inner housing to rotate about the clamp centerline axis relative to the outer housing, which rotation in turn causes the carriers to move radially inward and outward as the carrier pin travels along the actuator slot so as to selectively grip and release the drill pipe disposed in the central passage along the clamp centerline axis.

In one embodiment, the powered linear actuator(s) are hydraulically powered.

In another embodiment, the powered linear actuator(s) are pneumatically powered.

In still another embodiment, the powered linear actuator(s) are electrically powered.

In a further embodiment, the outer housing further comprises a plurality of rollers disposed on axles extending between the upper plate and the lower plate parallel to the clamp centerline axis for radially supporting the inner housing.

In yet another embodiment, the rollers of the outer housing are straight sided rollers.

In another embodiment, the rollers of the outer housing are center tapered rollers.

In still another embodiment, the rollers of the outer housing are configured in a plurality of groups of rollers, the spacing between the adjacent axles of the rollers within a group being less that the spacing between the adjacent axles of rollers in different groups, and the number of groups of rollers is same as the number of carriers.

In a further embodiment, each respective group of the plurality of groups of rollers is disposed on the outer housing radially outwardly adjacent to a respective actuator slot on the inner housing and radially aligned with a respective one of the carriers.

In yet another embodiment, a wedge angle is defined at each point along each of the actuation slots from a beginning point at the OPEN end of the actuation slot to an end point at the CLOSE end of the actuation slot, the wedge angle at a particular point being formed between the direction of the centerline of the actuation slot at the particular point and the direction of a tangent line relative to the clamp centerline axis at the particular point. The wedge angle for the beginning point of the actuation slot is greater than the wedge angle for the end point of the actuation slot.

In another embodiment, the wedge angle of the actuation slots of the inner housing in at least the final 50% of the length of the actuation slot is relatively constant.

In still another embodiment, the wedge angle of the actuation slots of the inner housing in at least the final 50% of the length of the actuation slot is within the range from 4.25° to 4.75°.

In yet another embodiment, the wedge angle of the actuation slots of the inner housing in at least the final 40% of the length of the actuation slot is about 4.5°.

In yet another aspect, a powered clamp for transmitting rotational torque to a drill pipe comprises an outer housing connected to a plurality of carrier guides, the outer housing defining a central passage along a clamp centerline axis, and the plurality of carrier guides defining a plurality of slots between one another, the slots being radially oriented with respect to the clamp centerline axis. The powered clamp further comprises an inner housing defining a central passage along the clamp centerline axis. The inner housing is rotatably connected to the outer housing to allow rotation of the inner housing about the clamp centerline axis relative to the outer housing. The inner housing defines a plurality of actuator slots therein, and a plurality of carriers are slidably disposed in the slots between the carrier guides, each carrier having a carrier pin extending into one of the actuator slots of the inner housing. The powered clamp further comprises at least one powered linear actuator oriented substantially tangential to the clamp centerline axis and connected at a first end to the outer housing and at a second end to the inner housing. Selective extension and retraction of the linear actuator causes the inner housing to rotate about the clamp centerline axis relative to the outer housing, which rotation in turn causes the carriers to move radially inward and outward as the carrier pin travels along the actuator slot so as to selectively grip and release the drill pipe disposed in the central passage along the clamp centerline axis.

In one embodiment, a wedge angle is defined at each point along each of the actuation slots from a beginning point of the actuation slot to an end point of the actuation slot, the wedge angle at a particular point being formed between the direction of the centerline of the actuation slot at the particular point and the direction of a tangent line relative to the clamp centerline axis at the particular point, and the wedge angle for the beginning point of the actuation slot is greater than the wedge angle for the end point of the actuation slot.

In another embodiment, the wedge angle of the actuation slots of the inner housing in at least the final 50% of the length of the actuation slot is relatively constant.

In still another embodiment, the wedge angle of the actuation slots of the inner housing in at least the final 50% of the length of the actuation slot is within the range from 4.25 degrees to 4.75 degrees.

BRIEF DESCRIPTION OF THE DRAWINGS

For a more complete understanding, reference is now made to the following description taken in conjunction with the accompanying drawings in which.

DETAILED DESCRIPTION

Figure 1:
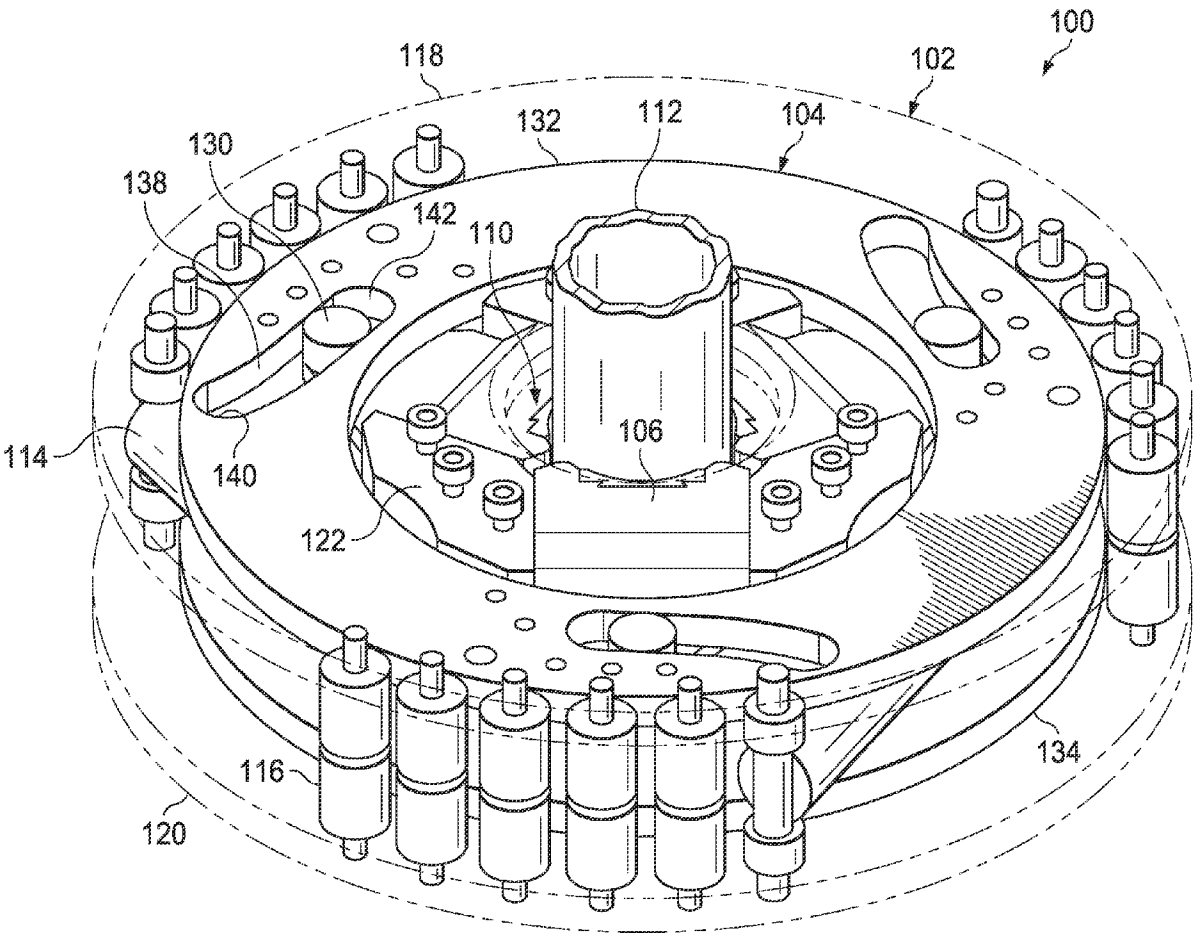
FIG. 1 is a perspective view of a powered milling clamp for drill pipe in accordance with one embodiment.
Figure 2:
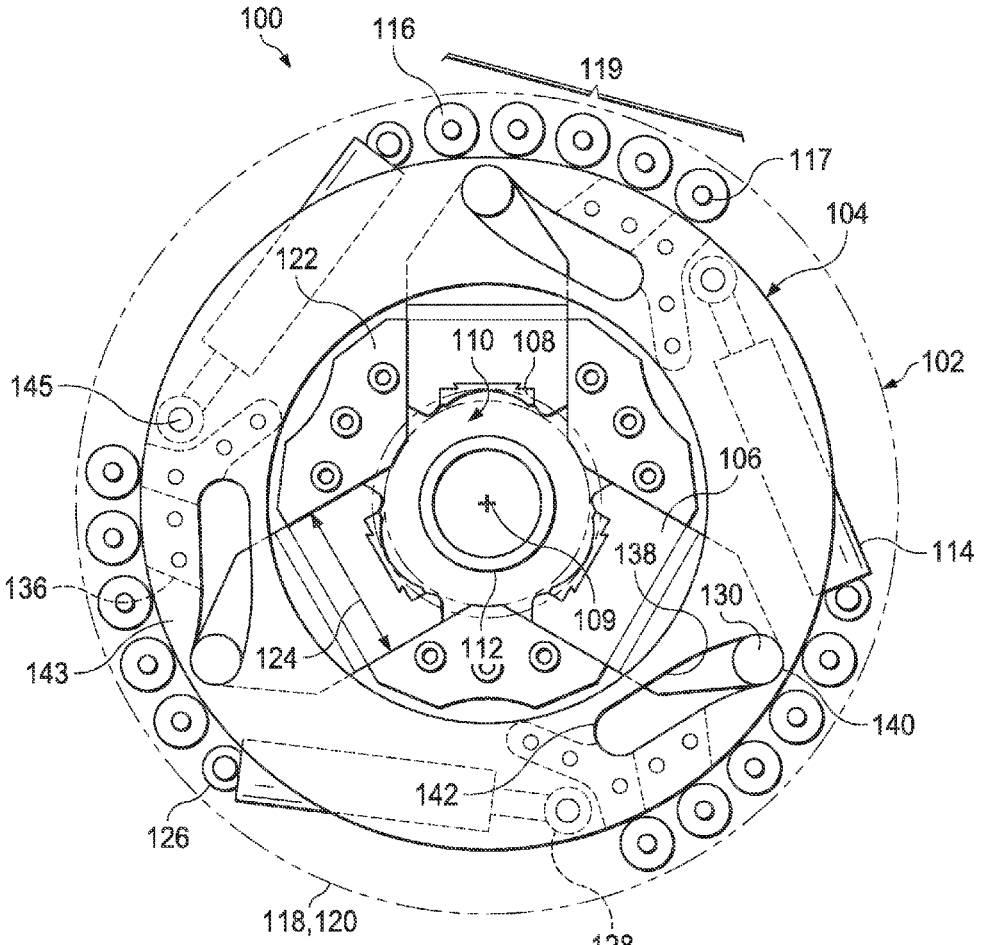
FIG. 2 is a top view of the clamp of FIG. 1, with portions shown partially transparent to illustrate the internal elements.

Referring first to FIGS. 1 and 2, there is illustrated a powered milling clamp 100 in accordance with one embodiment. For purposes of illustration, portions of the clamp 100 are shown partially transparent in FIGS. 1 and 2 so that underlying portions may be seen and described. In addition, a segment of drill pipe is illustrated in position for clamping. The powered milling clamp 100 comprises an outer housing 102, an inner housing 104 and a plurality of radially movable carriers 106 (also called grippers) for gripping pipe. The outer housing 102 is typically fixed to, and rotates with, the rotary of, e.g., a snubbing jack or a rig assist unit. The outer housing 102 and inner housing 104 are each configured to define a central passage 110 sized to allow the passage of a drill pipe 112 or casing therethrough. The inner housing 104 is mounted within the outer housing 102 so as to allow at least partial rotation of the inner housing around the central passage 110 with respect to the outer housing. In some embodiments, a plurality of rollers 116 are provided on the outer housing 102 for supporting the inner housing 104.

As best seen in FIG. 2, each of the carriers 106 may be configured to receive a power tong insert or pipe insert 108 on its inner face to provide a replaceable and/or selectively resizable gripping surface. In preferred embodiments, the inserts 108 are industry standard back up power tong inserts or pipe inserts. Pipe inserts 108 are available in various sizes corresponding to different pipe diameters, and can be switched out to allow the carriers 106 to grip pipe of different diameters. The carriers 106 are spaced around the central passage 110 with the inserts 108 facing the clamp centerline axis 109 (i.e., the axis running through the center of the central passage where the drill pipe 112 will be positioned during operation). During typical operation of the powered milling clamp 100, the clamp centerline axis 109 will be vertically oriented. One or more tangentially oriented linear actuators 114 are connected between the outer housing 102 and the inner housing 104. The linear actuators 114 illustrated in FIGS. 1 and 2 are hydraulic powered actuators, however, pneumatically powered actuators and/or electrically powered actuators may be used in other embodiments. Selective extension and retraction of the actuators 114 causes the inner housing 104 to rotate back and forth relative to the outer housing 102, which in turn causes the carriers 106 (and the inserts 108, if provided) to move radially inward and outward so as to selectively grip and release the drill pipe 112 in the central passage 110.

Figure 3A:
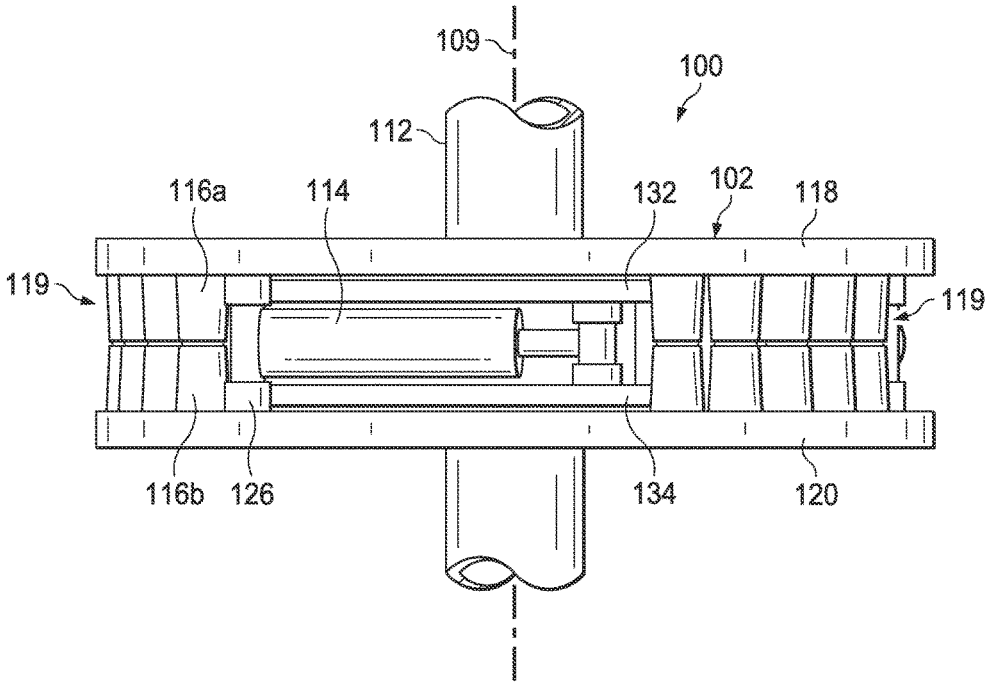
FIG. 3A is a side view of the clamp of FIG. 1 in accordance with one embodiment having two-piece tapered rollers.
Figure 3B:
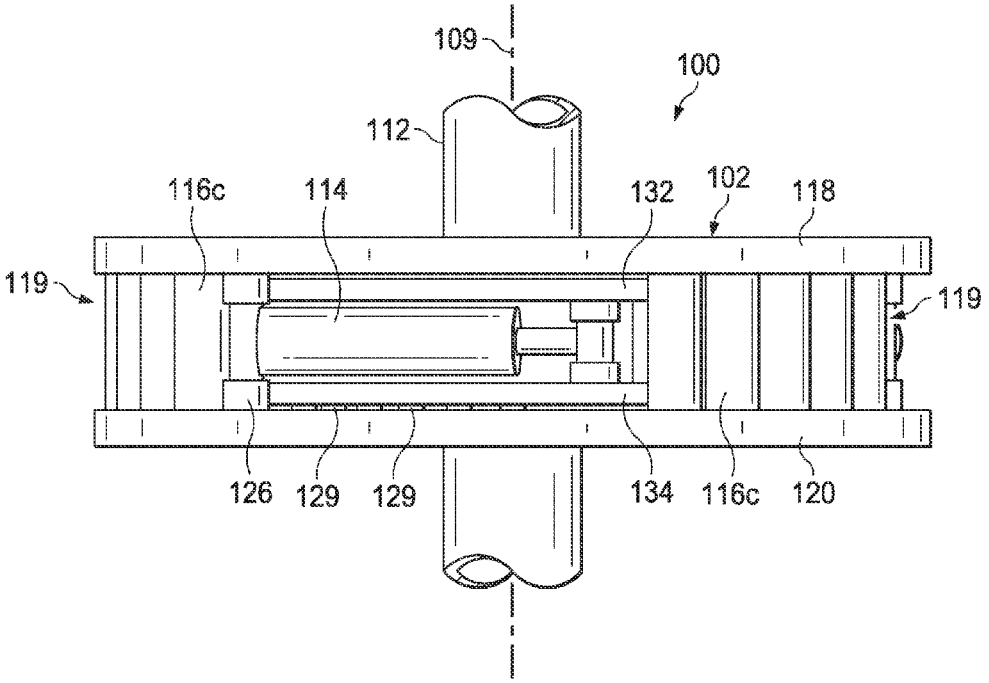
FIG. 3B is a side view of an alternative embodiment of the clamp of FIG. 1 having one-piece straight sided rollers.

Referring now also to FIGS. 3A and 3B, additional details of the structure and operation of the powered clamp 100 are provided. The outer housing 102 may include an upper plate 118 spaced-apart from a lower plate 120 and connected by a plurality of carrier guides 122 (FIG. 2) disposed therebetween. The lower plate 120 is typically operatively connected (e.g., using removable bolts) to the rotating part of the rotary to receive rotational torque from the rotary. In one embodiment, the lower plate 120 is bolted to conventional slip bowls, which in turn are bolted to the rotating part of the rotary. In another embodiment, the lower plate 120 is bolted to an adapter spool, which is bolted to the rotating part of the rotary.

As best seen in FIG. 2, the carrier guides 122 are connected to the lower plate 120 so as to also receive the rotational torque from the rotary. The connection of the lower plate 120 to the carrier guides 122 may be permanent (e.g., by welding) or removable (e.g., by bolting). The carrier guides 122 are spaced apart from one another and configured to define a plurality of radially oriented slots (denoted by arrow 124 in FIG. 2). The carriers 106 are positioned within the slots 124 and constrained to move only in the radial direction (relative to the clamp centerline axis 109) by the walls of the slots (i.e., by the sides of the carrier guides 122). The upper plate 118 is typically removably connected (e.g., by bolting) to the lower plate 120 and/or carrier guides 122 so as to allow access to the inner housing 104, carriers 106, inserts 108 and/or other internal components of the clamp 100.

The linear actuators 114 are generally tangentially oriented (relative to the clamp centerline axis 109) and radially spaced apart from one another. Each linear actuator 114 has an outer end 126 connected to the outer housing 102 and an inner end 128 connected to the inner housing 104. As previously described, as the actuators 114 are selectively extended and retracted, the inner housing 104 rotates back and forth about the centerline axis 109 relative to the outer housing 102.

A plurality of rollers 116 may be provided on the outer housing 102 to rotatably support the inner housing 114. The rollers 116 may be mounted on axles 117 extending between the upper plate 118 and the lower plate 120 and oriented parallel to the clamp centerline axis 109. In some embodiments, the rollers 116 may be evenly spaced around the periphery of the outer housing 102, whereas in other embodiments, the rollers may be positioned in localized groups of multiple rollers, with the groups being evenly spaced around the periphery of the outer housing (even though the rollers themselves are not evenly spaced). In still other embodiments, the rollers 116 and/or groups 119 may be unevenly spaced. A group of rollers may be considered a subset of the plurality of rollers 116 wherein the spacing between the adjacent axles 117 within the subset is less that the spacing between the axles of the outermost rollers in that subset and the nearest axles of the adjacent subset(s). Arranging the rollers 116 into groups 119 allows the support provided by the rollers to be concentrated in the areas where such support is most needed. For example, in the illustrated embodiment of FIG. 2, three groups 119 of rollers 116 are evenly spaced around the periphery of outer housing 102, with each group having five axles 117 evenly spaced within the respective group. It will be seen that the spacing between the axles 117 within a group 119 is less that the spacing between the axles of adjacent groups.

In the embodiment illustrated in FIG. 3A, the rollers 116 are tapered rollers, and the edges of the inner housing 114 may have a complementary tapered configuration that allows the edges of the inner housing to fully contact the tapered rollers. In some tapered roller embodiments, the rollers 116 are center tapered (i.e., tapering from each end with the thinnest portion somewhere in the middle), and the edges of the inner housing 114 may have a complementary center tapered configuration that allows the edges of the inner housing to fully contact the center tapered rollers. In some such embodiments, the center tapered rollers are provided using one-piece rollers 116 with a center taper, whereas in other embodiments (such as that illustrated in FIG. 3A) the center tapered rollers are provided by mounting two or more tapered rollers 116*a*, 116*b* on each axle with the respective tapers oriented in opposite directions.

In an alternative embodiment illustrated in FIG. 3B, the rollers 116 are straight rollers (i.e., straight-sided), and the edges of the inner housing 114 may have a complementary straight configuration (i.e., with edges perpendicular to the bottom plate 134) that allows the edges of the inner housing to fully contact the straight rollers. In some straight roller embodiments (such as that illustrated in FIG. 3B), the rollers 116 are one-piece straight rollers 116*c*, whereas in other embodiments the straight rollers are provided by mounting two or more smaller straight rollers on each axle.

Referring still to FIG. 3B, one or more horizontal bearings 129 may be provided between the lower plate 120 of the outer housing 102 and the bottom plate 134 of the inner housing 104. The horizontal bearing(s) 129 provide a sliding surface to facilitate relative movement between the inner and outer housings 104, 102. In the illustrated embodiment, the horizontal bearings 129 comprises a plurality of UHMW polyethylene pads or "buttons" disposed between the lower plate 120 and the bottom plate 134. In other embodiments, the horizontal bearing 129 may comprise a sheet of UMMW polyethylene or other low-friction polymer disposed between the lower plate 120 and the bottom plate 134. In still other embodiment, the horizontal bearing may comprise buttons, pads and/or horizontal surfaces of hardened steel in contact with one another.

Referring again to FIGS. 3A and 3B, the inner housing 104 may include a top plate 132 spaced-apart from a bottom plate 134 and connected by a plurality of spacers 136 (FIG. 2) disposed therebetween. The top plate 132 and bottom plate 134 preferably have a ring-shaped configuration disposed radially outward from the carrier guides 122 when the clamp 100 is assembled. The top plate 132 and bottom plate 134 are preferably spaced apart to accommodate the gripper/carriers 106 therebetween. The connection of the bottom plate 134 to the spacers 136 may be permanent (e.g., by welding) or removable (e.g., by bolting). The top plate 132 is typically removably connected (e.g., by bolting) to the bottom plate 134 and/or spacers 136 so as to allow access to the carriers 106 and/or other internal components of the clamp 100.

Figure 5:
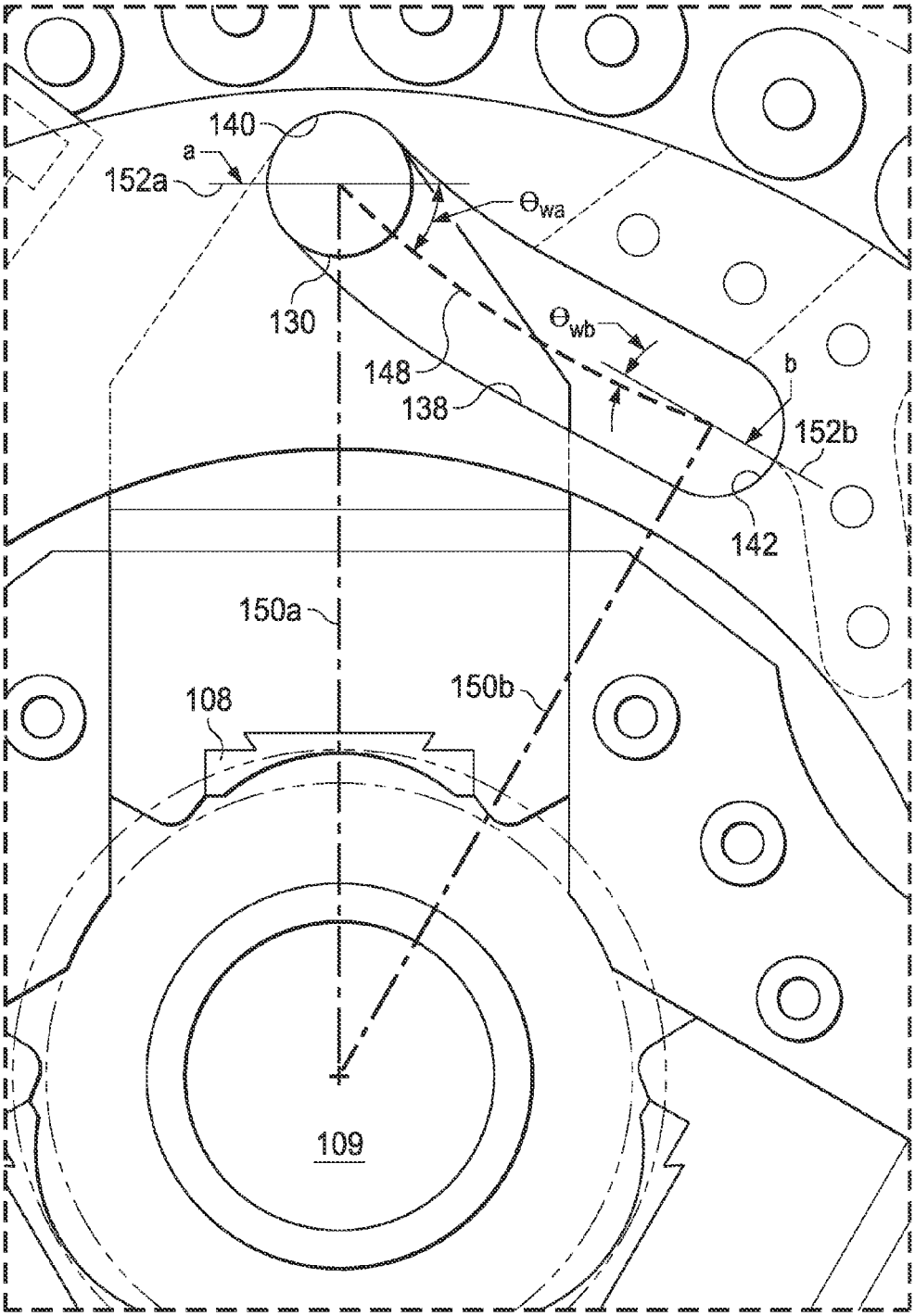
FIG. 5 is an enlarged view of a portion of FIG. 4A, illustrating the wedge angle of the actuator slot.

Referring again to FIG. 2 and also to FIG. 5, a plurality of actuation slots 138 are formed in the top plate 132 and/or bottom plate 134 (preferably both) of the inner housing 104 and dimensioned to receive a carrier pin 130 connected to each gripper/carrier 106. The actuation slot 138 follows a generally spiral path with respect to the clamp centerline axis 109. For purposes of this application, the term "generally spiral path" means that the radial distance 150 from the clamp centerline 109 to the centerline 148 of the slot 138 gets continuously smaller from a first end 140 (i.e., the "OPEN" end) of the slot to a second end 142 (i.e., the "CLOSE" end) of the slot.

Figure 4A:
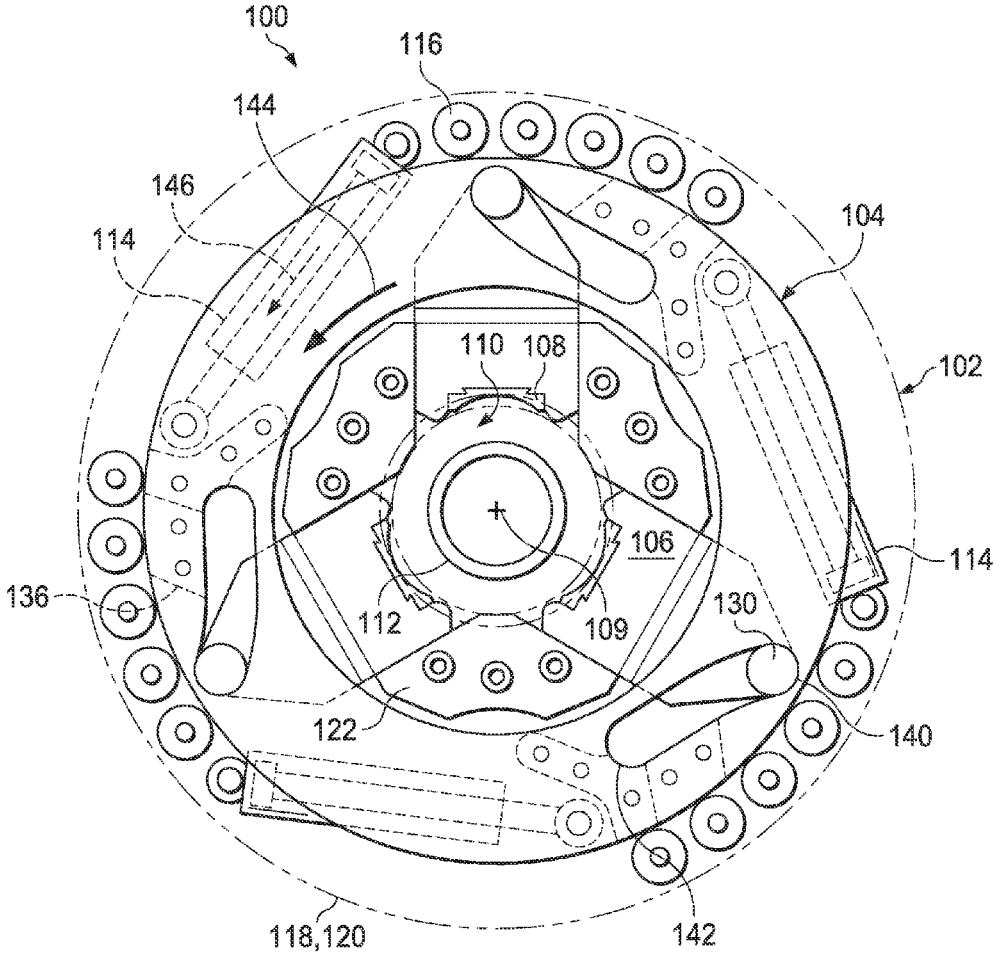
FIG. 4A is a top view of the clamp, shown in the open (i.e., unclamped) configuration.
Figure 4B:
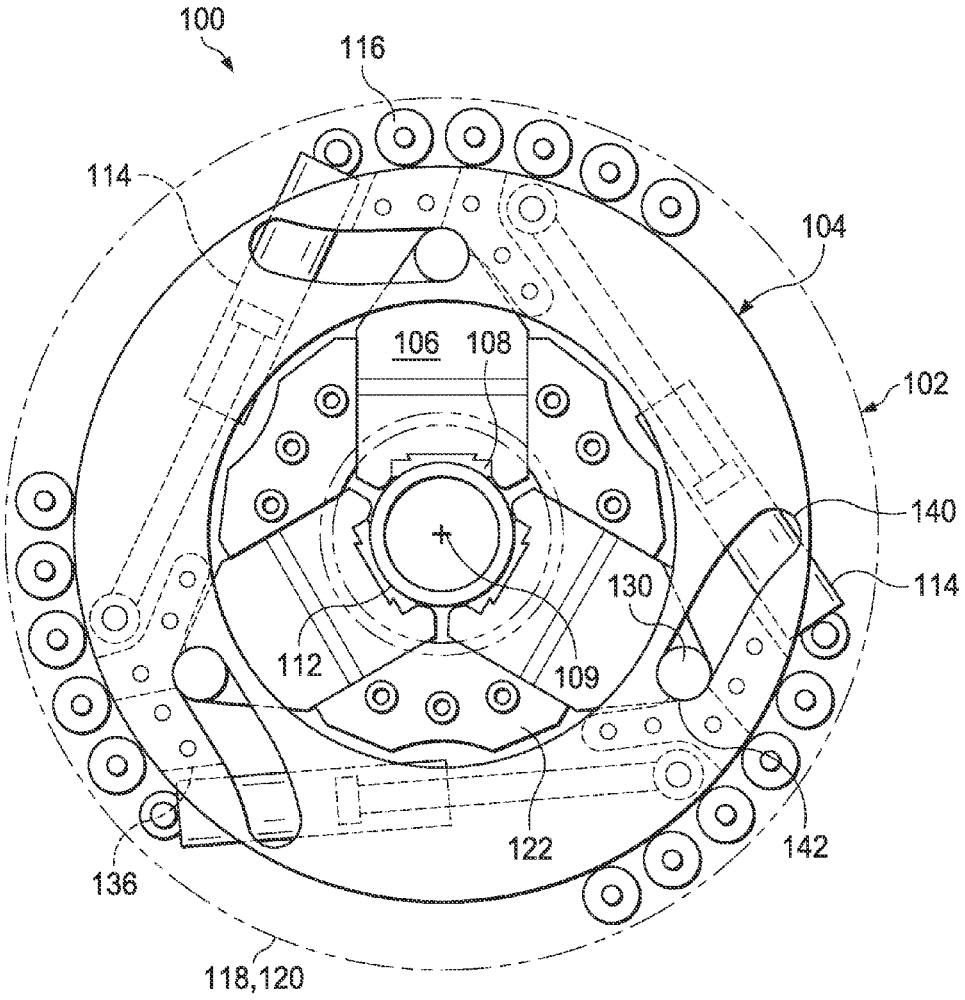
FIG. 4B is a top view of the clamp of FIG. 4, shown in the closed (i.e., clamped) configuration.

As best seen in FIGS. 2, 4A and 4B, in some embodiments, portions 143 of the inner housing 104 located radially outward from each actuation slot 138 may receive relatively less radial support from the structure of the inner housing than portions not located outward from the actuation slots. These less-supported portions 143 may be subject to undesirable deformation from the carrier pin 130 during operation of the clamp 100. Further, portions of the inner housing 104 around the attachment points 145 of the linear actuators 114 may be subjected to greater stress than other areas. To provide additional radial support for these less-supported portions 143 or highly stressed portions 145 of the inner housing 104, groups 119 of rollers 116 may be mounted on portions of the outer housing 102 radially adjacent to the less-supported or highly stressed portions of the inner housing. These rollers 116 provide radial support for the inner housing 104, i.e., they may provide radially inward directed force to keep the inner housing 104 centered within the outer housing 102, they may provide radially inward directed force to resist deformation of the less-supported portions 143 as they move past the carrier pin 130, and they may provide radially inward directed force to resist deformation of the highly stressed portions 145 during operation of the linear actuators 114. In the illustrated embodiment (FIG. 2), three groups 119 of rollers 116 are provided on the outer housing 102; one group 119 being disposed radially outwardly adjacent to each of the three less supported portions 143, which are themselves radially outwardly adjacent to each of the three actuation slots 138. As best seen in FIGS. 4A and 4B, the groups 119 are also disposed radially outwardly adjacent to the highly stressed portions 145 during the later (i.e., clamp closed) portion of the actuator stroke.

As best seen in FIG. 5, the wedge angle (denoted $\theta_W$) at any point a, b along the actuation slot 138 is the angle formed between the centerline 148 of the actuation slot (at that point) and a tangent line 152 (at that point) relative to the clamp centerline 109. For example, in FIG. 5 the carrier pin 130 is at the OPEN end 140 of the actuator slot 138, with its center at point a, thus the wedge angle $\theta_{Wa}$ at the OPEN end is the angle formed between the slot centerline 148 at point a and the tangent line 152*a* at the radius 150*a*. When the carrier pin 130 is at the CLOSE end 142 of the actuator slot 138, with its center at point b, the wedge angle $\theta_{Wb}$ at the CLOSE end is the angle formed between the slot centerline 148 at point b and the tangent line 152*b* at the radius 150*b*.

In certain preferred embodiments, the wedge angle $\theta_W$ in the initial portion of the actuation slot 138 (i.e., the portion closest to the OPEN end 140), is greater than the wedge angle $\theta_W$ in the final portion (i.e., the portion closest to the CLOSE end 142), thereby providing relatively fast movement of the grippers/carriers 106 during the initial portion of the closing stroke and relatively slower movement during the final portion of the closing stroke. In other preferred embodiments, the wedge angle $\theta_W$ in at least the final 50% of the slot 138 is relatively constant (i.e., within 0.5 degrees). In more preferred embodiments, the wedge angle $\theta_W$ in at least the final 50% of the slot 138 is within the range of 4.25° to 4.75°. In still other preferred embodiments, the wedge angle $\theta_W$ in at least the final 40% of the slot 138 is about 4.5°.

As previously described, the outer housing 102 may be fixed to, and rotate with, the rotary of the snubbing jack or rig assist unit. The inner housing 104 may be partially or fully supported by radially spaced rollers 116, or by radially spaced groups 119 of rollers, which rollers may be, e.g., tapered rollers 116*a*, 116*b* or straight rollers 116*c*. Tapered rollers 116*a*, 116*b* may provide both vertical and radial support for the inner housing 104 within the outer housing, whereas straight sided rollers 116*c* may provide only radial support. In such case, horizontal bearings 129, which may be, e.g., UHMW polyethylene or hardened steel surfaces, may be provided for vertical support of the inner housing 104 within the outer housing 102. In this context, radial support of the inner housing 104 refers to providing radially-inward directed force to maintain the inner housing centered within the outer housing 102, and also to providing radially-inward directed force to resist deformation of the inner housing structure when the clamp is activated to grip a pipe. The linear actuators 114 couple the outer housing 102 and inner housing 104 and rotate the inner housing about the clamp center axis 109 with respect to the outer housing. The carriers 106 are held tangentially relative to the outer housing 102 by locating blocks (carrier guides) 122 forming tracks/slots 124. The carrier pin 130 on each carrier 106 projects into the actuator slots 138 on the inner housing 104.

Referring now to FIGS. 4A and 4B, there is illustrated the clamp 100 in the OPEN configuration (FIG. 4A) and the CLOSE configuration (FIG. 4B) to shown the relative positions of the component parts. During the closing (i.e., clamping) stroke, the inner housing 104 is rotated (denoted by arrow 144) relative to the outer housing 102 by action of the actuators 114 (denoted by arrow 146), and the carrier pins 130 are forced to follow the actuator slots 138 from the OPEN end 140 toward the CLOSE end 142, thereby driving the carriers 106 (and the inserts 108, if provided) radially into contact with the drill pipe/casing 112. Preferably, during the initial portion of the clamping stroke (i.e., until contact with the drill pipe 112), the wedge angle $\theta_W$ is relatively high, resulting in relatively faster movement of the carriers 106, but relatively lower radial clamping force (i.e., compared to the final portion of the stroke). Additional movement/force from the linear actuators 114 results in further movement of the carrier pins 130 to create a substantial clamp load on the drill pipe. This clamp load transmits the rotational torque from the rotary to the drill pipe/casing 112. Preferably, during the final portion of the clamping stroke (i.e., after contact with the drill pipe), the wedge angle $\theta_W$ is relatively low, resulting in relatively slower movement of the carriers 106, but relatively higher radial clamping force (i.e., compared to the initial portion of the stroke).

During the opening (i.e., unclamping) stroke, the direction of movement of the actuators 114 is reversed and the inner housing 104 is rotated back to its original position relative to the outer housing 102, so that the carrier pins 130 follow the actuator slots 138 from the CLOSE end 142 toward the OPEN end 140. The carriers 106 (and the inserts 108, if provided) initially reduce the clamping force on the drill pipe 112, then move out of contact.

It will be appreciated that the powered milling clamp 100 can be sized according to the customer's specification to accommodate (i.e., work effectively with) multiple drill pipe/casing diameters and torque ratings. Further, it will be appreciated that, when the carriers 106 are configured to use removable power tong inserts or pipe inserts 108, a single powered milling clamp 100 may be selectively re-sized to accommodate pipes of various different sizes within a preselected range of sizes by selectively installing different pipe inserts designed for different pipe diameters within the preselected range. Further still, the linear actuators 114 may by hydraulically-, pneumatically- or electrically-powered as desired. The powered milling clamp 100 is more efficient, safer and more reliable than the existing manual milling clamps.

Although the preferred embodiment has been described in detail, it should be understood that various changes, substitutions and alterations can be made therein without departing from the spirit and scope of the invention as defined by the appended claims.

What is claimed is:

1. A powered clamp for transmitting rotational torque from a rotary drive to a drill pipe, comprising:

an outer housing adapted for releasable attachment to the rotary drive to receive torque from the rotary drive, the outer housing having an upper plate and a lower plate connected to a plurality of carrier guides disposed therebetween, the upper plate and lower plate defining a central passage along a clamp centerline axis, and the plurality of carrier guides defining a plurality of slots between one another, the slots being radially oriented with respect to the clamp centerline axis;

an inner housing having a top plate and a bottom plate connected to a plurality of spacers disposed therebetween and defining a central passage along the clamp centerline axis;

the inner housing being disposed between the upper and lower plates of the outer housing and rotatably connected to the outer housing to allow rotation of the inner housing about the clamp centerline axis relative to the outer housing;

at least one of the top and bottom plates defining a plurality of actuator slots therein, each of the actuator slots having a generally spiral configuration relative to the clamp centerline axis;

a plurality of carriers slidably disposed between the top and bottom plates of the inner housing and in the slots between the carrier guides, each carrier having a carrier pin extending into one of the actuator slots of the inner housing; and at least one powered linear actuator oriented substantially tangential to the clamp centerline axis and connected at a first end to the outer housing and at a second end to the inner housing;

wherein selective extension and retraction of the linear actuator(s) causes the inner housing to rotate about the clamp centerline axis relative to the outer housing, which rotation in turn causes the carriers to move radially inward and outward as the carrier pin travels along the actuator slot so as to selectively grip and release the drill pipe disposed in the central passage along the clamp centerline axis;

wherein the outer housing further comprises a plurality of rollers disposed on axles extending between the upper plate and the lower plate parallel to the clamp centerline axis for radially supporting the inner housing; and wherein:

the rollers of the outer housing are configured in a plurality of groups of rollers, a spacing between adjacent axles of the rollers within a group being less than a spacing between adjacent axles of rollers in different groups; and a number of groups of rollers is the same as a number of carriers.

2. A powered clamp in accordance with claim 1, wherein the powered linear actuator(s) are hydraulically powered.

3. A powered clamp in accordance with claim 1, wherein the powered linear actuator(s) are pneumatically powered.

4. A powered clamp in accordance with claim 1, wherein the powered linear actuator(s) are electrically powered.

5. A powered clamp in accordance with claim 1, wherein the rollers of the outer housing are straight sided rollers.

6. A powered clamp in accordance with claim 1, wherein the rollers of the outer housing are center tapered rollers.

7. A powered clamp in accordance with claim 1 wherein each respective group of the plurality of groups of rollers is disposed on the outer housing radially outwardly adjacent to a respective actuator slot on the inner housing and radially aligned with a respective one of the carriers.

8. A powered clamp in accordance with claim 1, wherein:

a wedge angle is defined at each point along each of the actuation slots from a beginning point at an open end of the actuation slot to an end point at a closed end of the actuation slot, the wedge angle at a particular point being formed between a direction of the centerline of the actuation slot at the particular point and a direction of a tangent line relative to the clamp centerline axis at the particular point; and the wedge angle for the beginning point of the actuation slot is greater than the wedge angle for the end point of the actuation slot.

9. A powered clamp in accordance with claim 8, wherein the wedge angle of the actuation slots of the inner housing in at least a final 50% of a length of the actuation slot is relatively constant.

10. A powered clamp in accordance with claim 8, wherein the wedge angle of the actuation slots of the inner housing in at least a final 50% of a length of the actuation slot is within a range from 4.25 degrees to 4.75 degrees.

11. A powered clamp in accordance with claim 10, wherein the wedge angle of the actuation slots of the inner housing in at least a final 40% of a length of the actuation slot is about 4.5 degrees.

12. A powered clamp for transmitting rotational torque to a drill pipe, comprising:

an outer housing connected to a plurality of carrier guides, the outer housing defining a central passage along a clamp centerline axis, and the plurality of carrier guides defining a plurality of slots between one another, the slots being radially oriented with respect to the clamp centerline axis;

an inner housing defining a central passage along the clamp centerline axis;

the inner housing being rotatably connected to the outer housing to allow rotation of the inner housing about the clamp centerline axis relative to the outer housing;

the inner housing defining a plurality of actuator slots therein;

a plurality of carriers slidably disposed in the slots between the carrier guides, each carrier having a carrier pin extending into one of the actuator slots of the inner housing; and at least one powered linear actuator oriented substantially tangential to the clamp centerline axis and connected at a first end to the outer housing and at a second end to the inner housing;

wherein selective extension and retraction of the linear actuator(s) causes the inner housing to rotate about the clamp centerline axis relative to the outer housing, which rotation in turn causes the carriers to move radially inward and outward as the carrier pin travels along the actuator slot so as to selectively grip and release the drill pipe disposed in the central passage along the clamp centerline axis wherein:

a wedge angle is defined at each point along each of the actuation slots from a beginning point of the actuation slot to an end point of the actuation slot, the wedge angle at a particular point being formed between a direction of the centerline of the actuation slot at the particular point and a direction of a tangent line relative to the clamp centerline axis at the particular point; and the wedge angle for the beginning point of the actuation slot is greater than the wedge angle for the end point of the actuation slot; and wherein the wedge angle of the actuation slots of the inner housing in at least a final 50% of a length of the actuation slot is within a range from 4.25 degrees to 4.75 degrees.

13. A powered clamp in accordance with claim 12, wherein the wedge angle of the actuation slots of the inner housing in at least a final 50% of a length of the slot is relatively constant.

14. A powered clamp for transmitting rotational torque from a rotary drive to a drill pipe, comprising:

an outer housing adapted for releasable attachment to the rotary drive to receive torque from the rotary drive, the outer housing having an upper plate and a lower plate connected to a plurality of carrier guides disposed therebetween, the upper plate and lower plate defining a central passage along a clamp centerline axis, and the plurality of carrier guides defining a plurality of slots between one another, the slots being radially oriented with respect to the clamp centerline axis;

an inner housing having a top plate and a bottom plate connected to a plurality of spacers disposed therebetween and defining a central passage along the clamp centerline axis;

the inner housing being disposed between the upper and lower plates of the outer housing and rotatably connected to the outer housing to allow rotation of the inner housing about the clamp centerline axis relative to the outer housing;

at least one of the top and bottom plates defining a plurality of actuator slots therein, each of the actuator slots having a generally spiral configuration relative to the clamp centerline axis;

a plurality of carriers slidably disposed between the top and bottom plates of the inner housing and in the slots between the carrier guides, each carrier having a carrier pin extending into one of the actuator slots of the inner housing; and at least one powered linear actuator oriented substantially tangential to the clamp centerline axis and connected at a first end to the outer housing and at a second end to the inner housing;

wherein selective extension and retraction of the linear actuator(s) causes the inner housing to rotate about the clamp centerline axis relative to the outer housing, which rotation in turn causes the carriers to move radially inward and outward as the carrier pin travels along the actuator slot so as to selectively grip and release the drill pipe disposed in the central passage along the clamp centerline axis;

wherein a wedge angle is defined at each point along each of the actuation slots from a beginning point at an open end of the actuation slot to an end point at a closed end of the actuation slot, the wedge angle at a particular point being formed between a direction of the centerline of the actuation slot at the particular point and a direction of a tangent line relative to the clamp centerline axis at the particular point; and the wedge angle for the beginning point of the actuation slot is greater than the wedge angle for the end point of the actuation slot; and wherein the wedge angle of the actuation slots of the inner housing in at least a final 50% of a length of the actuation slot is within a range from 4.25 degrees to 4.75 degrees.

15. A powered clamp in accordance with claim 14, wherein the wedge angle of the actuation slots of the inner housing in at least a final 40% of a length of the actuation slot is about 4.5 degrees.

* * * * *